US012312159B2

(12) United States Patent
Warren et al.

(10) Patent No.: US 12,312,159 B2
(45) Date of Patent: May 27, 2025

(54) BULK MATERIAL CONTAINER FOR WELL OPERATIONS SYSTEM SUPPLY AND TRANSPORT

(71) Applicant: Halliburton Energy Services, Inc., Houston, TX (US)

(72) Inventors: Wesley John Warren, Duncan, OK (US); Chad A. Fisher, Duncan, OK (US); Austin Carl Schaffner, Duncan, OK (US); Cameron Michael Kramer, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 839 days.

(21) Appl. No.: 17/543,153

(22) Filed: Dec. 6, 2021

(65) Prior Publication Data

US 2023/0174295 A1 Jun. 8, 2023

(51) Int. Cl.

| | |
|---|---|
| ***B65D 88/56*** | (2006.01) |
| ***B65D 88/12*** | (2006.01) |
| ***B65D 90/00*** | (2006.01) |

(52) U.S. Cl.

CPC ..... *B65D 88/56* (2013.01); *B65D 88/126* (2013.01); *B65D 90/0033* (2013.01); *B65D 2588/12* (2013.01); *B65D 2588/54* (2013.01); *B65D 2590/666* (2013.01)

(58) Field of Classification Search

CPC .. B65D 88/56; B65D 88/126; B65D 90/0033; B65D 2588/12; B65D 90/666

USPC ..... 294/68.26, 81.53

See application file for complete search history.

(56) References Cited

U.S. PATENT DOCUMENTS

| | | | | |
|---|---|---|---|---|
| 2,070,586 A * | 2/1937 | Fitch | B65D 90/0033 | 292/197 |
| 3,015,407 A * | 1/1962 | Fesmire | B65D 90/0006 | 206/509 |
| 3,750,826 A * | 8/1973 | Donath | B65D 88/126 | 292/161 |
| 3,892,436 A * | 7/1975 | Fathauer | B66C 1/663 | 410/82 |
| 3,907,147 A * | 9/1975 | Goobeck | B65D 7/24 | 414/137.1 |
| 3,966,310 A * | 6/1976 | Larson | A61B 3/112 | 351/205 |

(Continued)

*Primary Examiner* — Paul T Chin

(74) *Attorney, Agent, or Firm* — Conley Rose, P.C.; Rodney B. Carroll

(57) ABSTRACT

A bulk material container can include a body, having a plurality of side walls, a bottom, a cavity, and an opening, and a first engagement element. The plurality of side walls are coupled to the bottom, and the cavity, which is configured to receive a bulk material, is formed within the plurality of side walls and above the bottom. The opening is formed by the plurality of side walls spatially opposite of the bottom and is configured to discharge the bulk material when the container is at least partially inverted. The first engagement element can be configured to receive one or more prongs of a transportation device or a bulk material unloading device. In some embodiments, the container may also include a second engagement element and/or a third engagement element, for example with the first, second, and/or third engagement elements differing from each other.

20 Claims, 11 Drawing Sheets

(56) References Cited

U.S. PATENT DOCUMENTS

| | | | | | |
|---|---|---|---|---|---|
| 4,144,984 | A * | 3/1979 | Saunders | B65D 88/126 | 220/4.24 |
| 4,335,828 | A * | 6/1982 | Robinson | B65F 1/16 | 220/826 |
| 4,726,616 | A * | 2/1988 | Schmidt | B65F 1/122 | 294/68.2 |
| 4,726,984 | A * | 2/1988 | Shah | B32B 27/306 | 156/244.11 |
| 4,913,301 | A | 4/1990 | Pickler | | |
| 5,111,950 | A * | 5/1992 | Wylenzek | B65D 88/129 | 220/8 |
| 6,357,365 | B1 * | 3/2002 | Higgins | B65D 88/022 | 108/55.1 |
| 7,464,504 | B2 * | 12/2008 | Hartzell | E04B 7/22 | 52/90.2 |
| 8,887,914 | B2 * | 11/2014 | Allegretti | B65D 19/06 | 108/51.11 |
| 9,303,147 | B2 * | 4/2016 | Kuribayashi | C09D 11/101 | |
| D783,771 | S * | 4/2017 | Stegemoeller | D23/202 | |
| 9,809,381 | B2 | 11/2017 | Oren et al. | | |
| 10,059,245 | B2 | 8/2018 | Goedken et al. | | |
| 10,076,733 | B2 | 9/2018 | Morris et al. | | |
| 10,518,229 | B2 | 12/2019 | Morris et al. | | |
| 10,640,288 | B2 | 5/2020 | Lucas et al. | | |
| 10,926,940 | B2 | 2/2021 | Allegretti et al. | | |
| 10,982,505 | B2 * | 4/2021 | Oehler | E21B 21/062 | |
| 12,113,224 | B2 * | 10/2024 | Zhou | H01M 4/921 | |
| 12,116,224 | B2 * | 10/2024 | Warren | B65G 65/23 | |
| 2019/0144216 | A1 | 5/2019 | Dawson et al. | | |
| 2020/0223346 | A1 | 12/2020 | Welch et al. | | |
| 2021/0178345 | A1 | 6/2021 | Arceneaux et al. | | |

* cited by examiner

BULK MATERIAL CONTAINER FOR WELL OPERATIONS SYSTEM SUPPLY AND TRANSPORT

TECHNICAL FIELD OF THE INVENTION

The present disclosure relates generally to bulk material containers, and more particularly, to bulk material containers for providing bulk material for use in well operations.

BACKGROUND

Bulk material such as proppant, gel particulate, dry-gel particulate, aggregate, feed, and other solid materials are used in a wide variety of contexts include, but not limited to, drilling and completion of oil and gas wells, concrete mixing applications, agriculture, and others. For drilling and completion of oil and gas wells, a bulk material such as proppant is typically mined at a remote location, then transported to a facility where it is rinsed and dried, and then transported to a wellsite where it is typically combined with water and chemical additives before being used in wellbore operations. Depending on the length of the wellbore, certain operations may require millions of pounds of bulk material, and because downtime on well means lost profits, the millions of pounds of bulk material must be ready when needed. Thus, in order to cut down on transportation costs and drying costs and to ensure that a sufficient amount of bulk material is ready at the wellsite when needed, operators have begun to resort to mining in the same oil field and using the wet proppant produced therefrom. The mined proppant is considered "wet proppant" when the moisture in the proppant is high enough to deter or inhibit the proppant's flowability, which becomes evident by the proppant's increased angle of repose compared to a dry sample of proppant. Typically, proppant is considered "wet" when the proppant contains from about 0.2% to about 15% residual liquid contents by weight. By removing the need for transporting wet proppant long distances and the need for drying the mined proppant, the use of wet proppant has the additional benefit of lowering the environmental impact of its use. However, there are obstacles operators must deal with when using wet proppant produced from the oilfield instead of dry bulk materials.

When handling dry bulk materials, typically the container is filled with dry bulk material through an opening in the top of the container, the filled container is transported to a location, and the bulk material is dumped from the container through a valve or gate disposed on a bottom of the container. However, these dry bulk material containers for handling free flowing dry bulk material are not conducive to use with wet bulk material such as wet proppant from an oil field. Dry bulk material containers typically have a taper at the bottom that funnels the dry bulk material to a valve or door that allows for emptying the container from the bottom. Wet proppant, however, clumps and does not flow as easily as dry material. Thus, a container for wet proppant that is able to be emptied completely is desired.

BRIEF DESCRIPTION OF THE DRAWINGS

FIGS. 1A-1J are diagrams of illustrative bulk material containers according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

A bulk material container able to store and fully unload wet proppant is desired. As discussed above, the term "wet proppant," as used herein, refers to a wetted well stimulation proppant having a liquid content sufficiently high to deter or inhibit the flowability of the proppant. The bulk material container may include a body having a cavity that leads to an opening, and one or more engagement elements. The one or more engagement elements may include engagement elements for coupling the bulk material container to a transportation device (e.g., a forklift, a crane, an ISO container handler, or a telehandler), engagement elements for coupling the bulk material container to a transportation vehicle (e.g., a truck, a trailer, or a train car) or another bulk material container, and engagement elements for coupling the bulk material container to a container unloading device. In one or more embodiments, the bulk material container may additionally include locating elements for aligning and coupling bulk material containers that are stacked on top of each other. Thus, in one or more embodiments, the bulk material containers carrying wet proppant may be transported to a wellsite, coupled to a container unloading device, and unloaded directly or indirectly into a blender for mixing with fluids so that those mixed fluids may be used in wellbore operations.

Illustrative embodiments of the present invention are described in detail herein. In the interest of clarity, not all features of an actual implementation may be described in this specification. It will of course be appreciated that in the development of any such actual embodiment, numerous implementation specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein, are intended to mean either an indirect or direct connection. Thus, by way of example, if a first device couples to a second device, that connection may be through a direct physical connection or through an indirect connection by way of straps, chains, or other elements of the container.

Figure 1A:
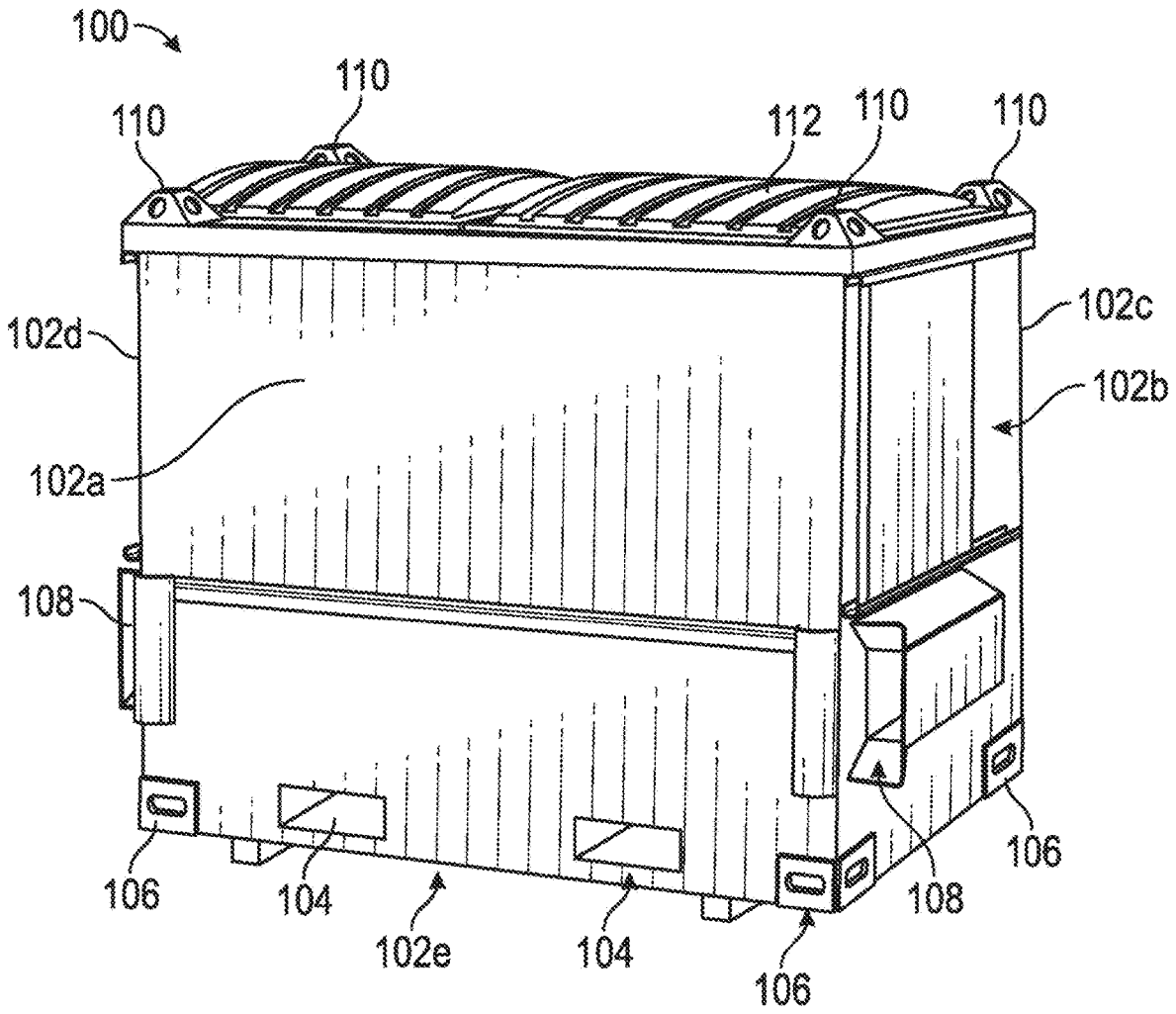
Figure 1B:
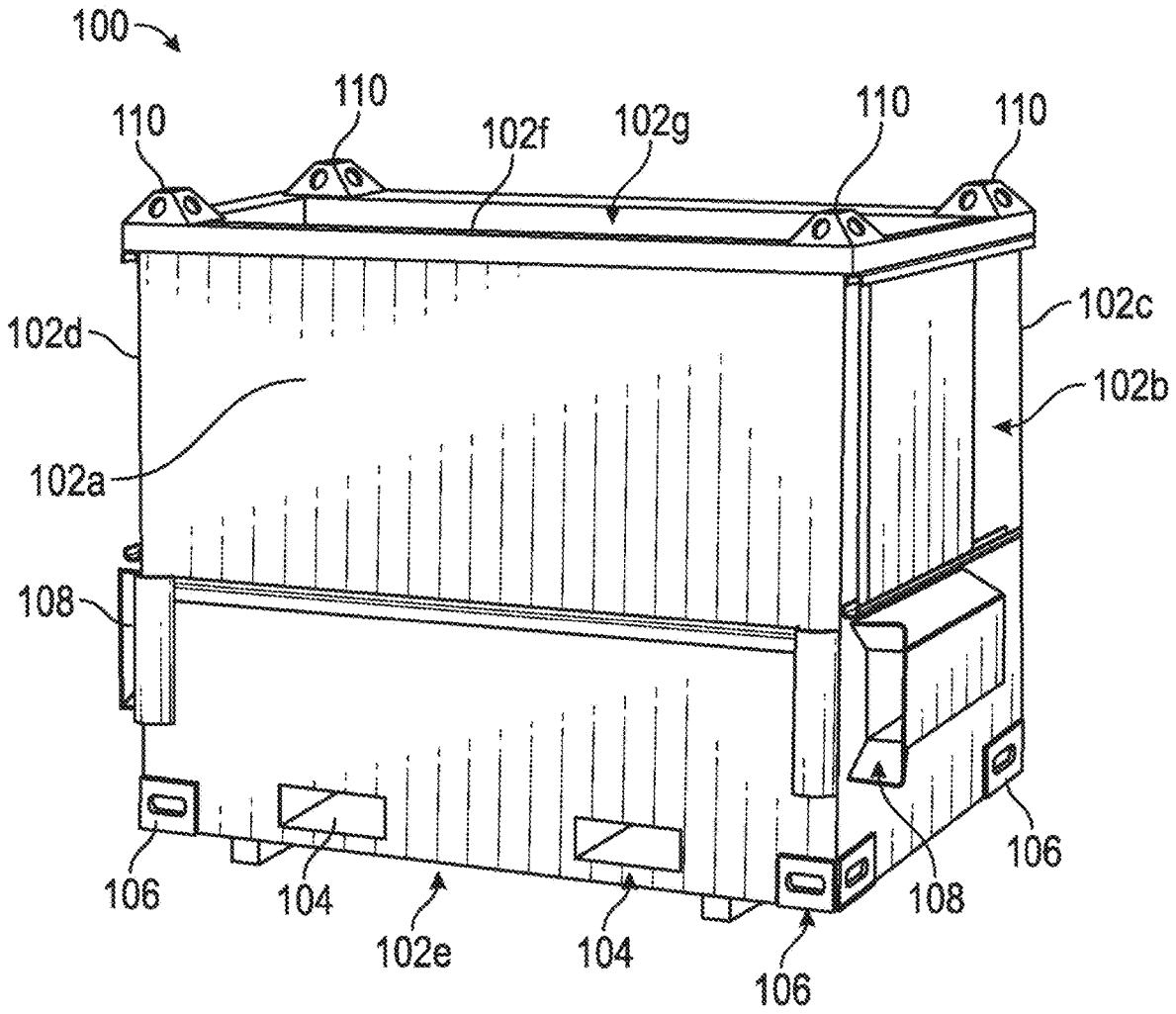
Figure 1C:
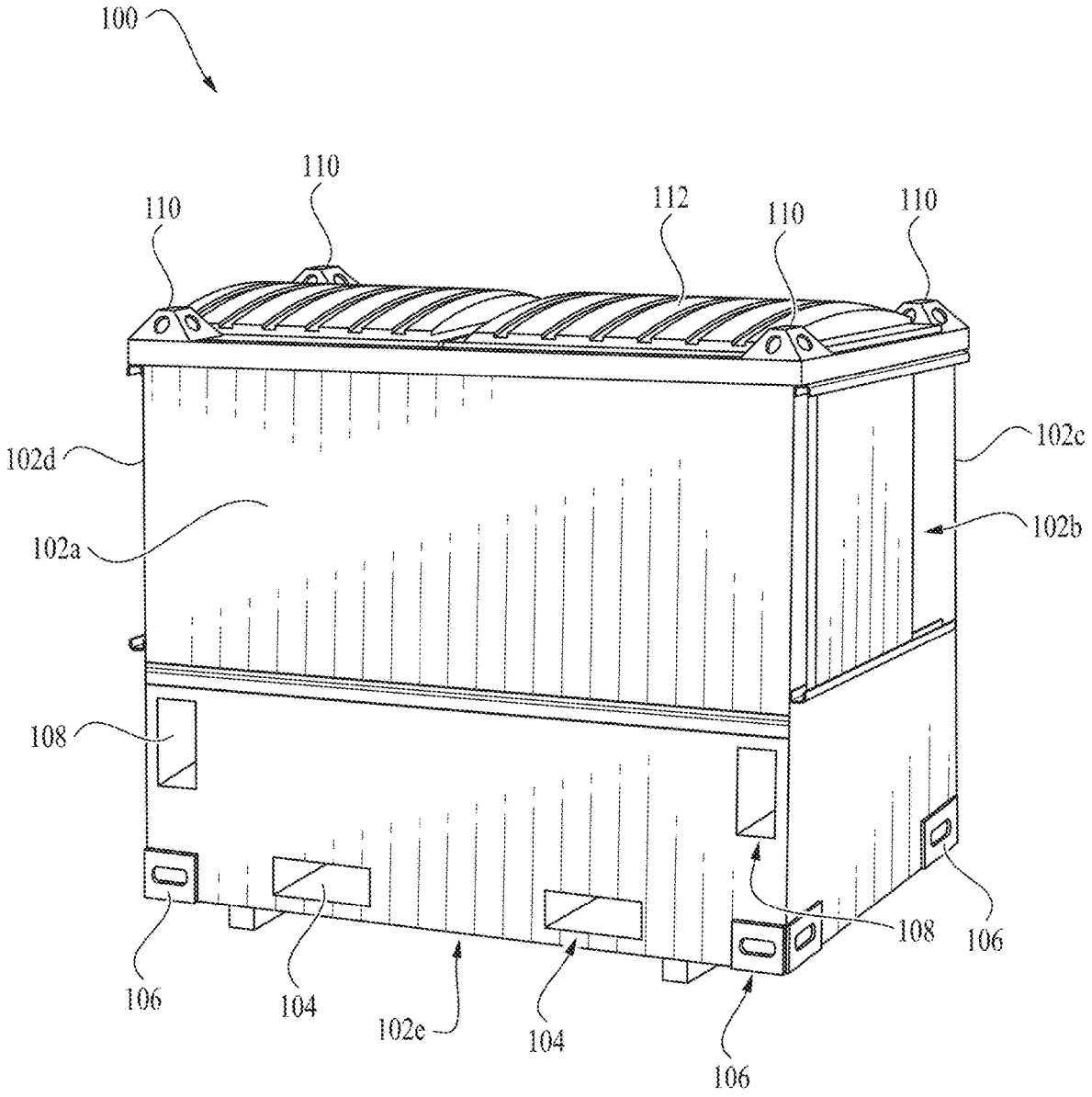
Figure 1D:
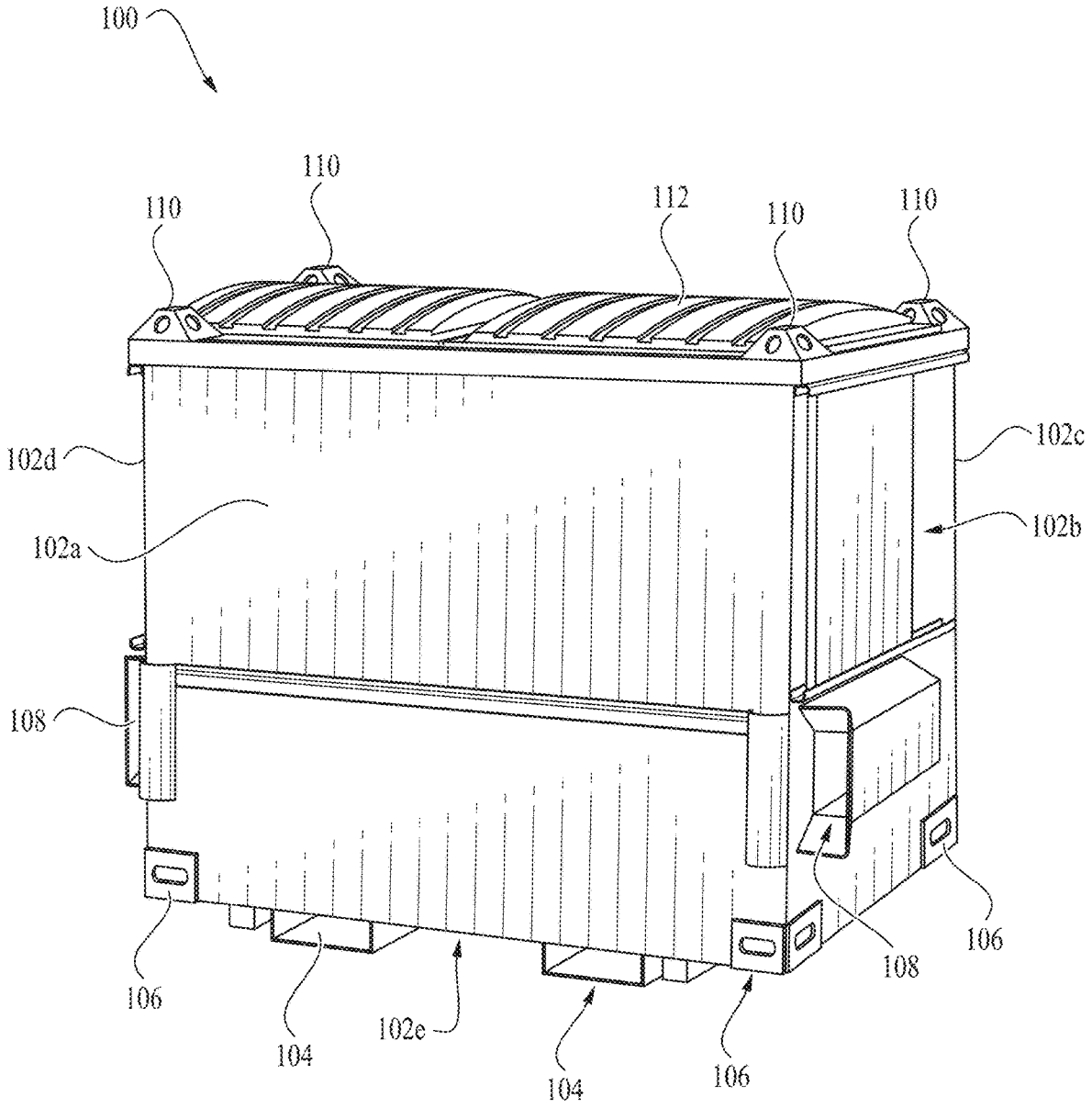
Figure 1E:
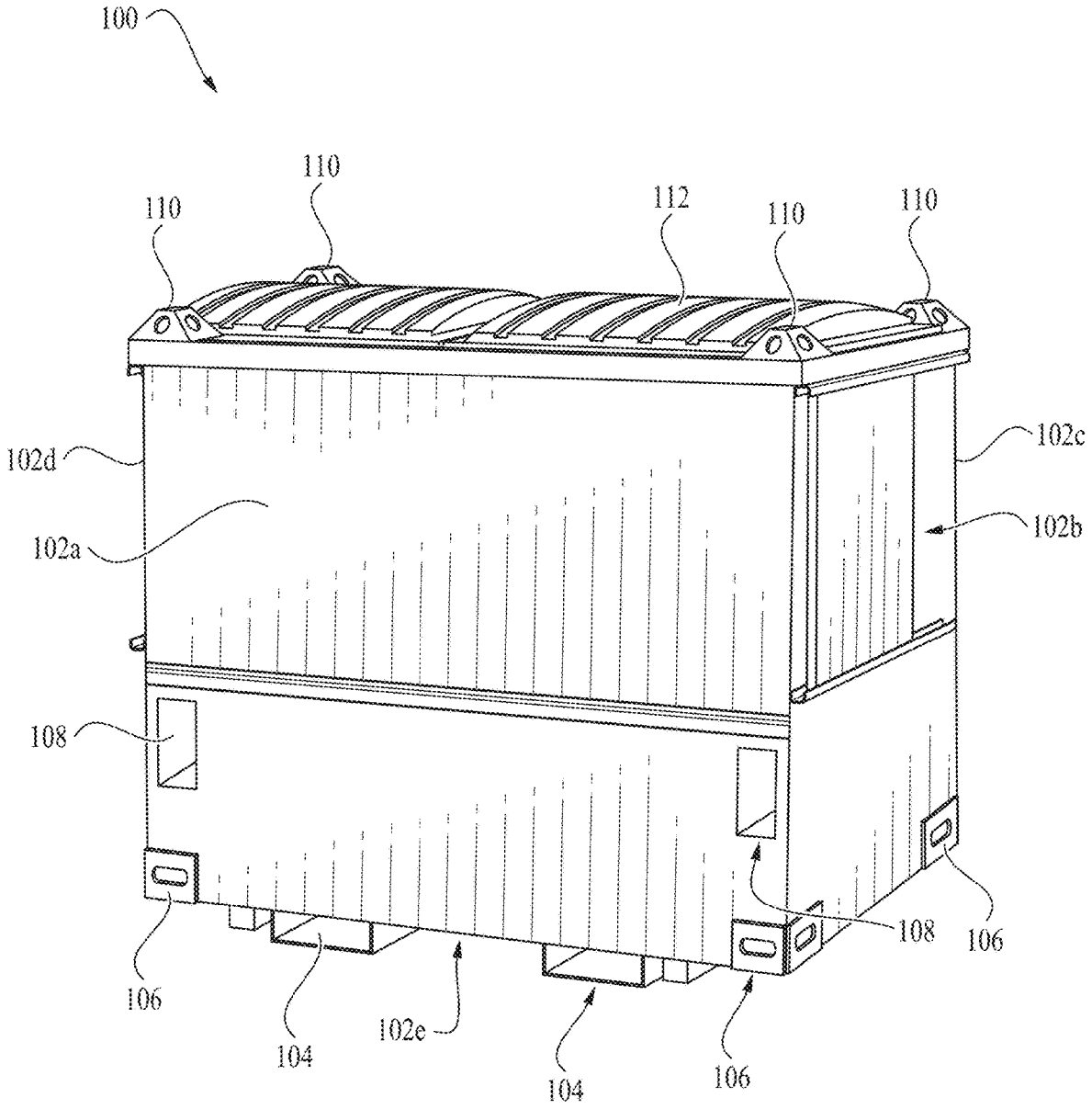
Figure 1F:
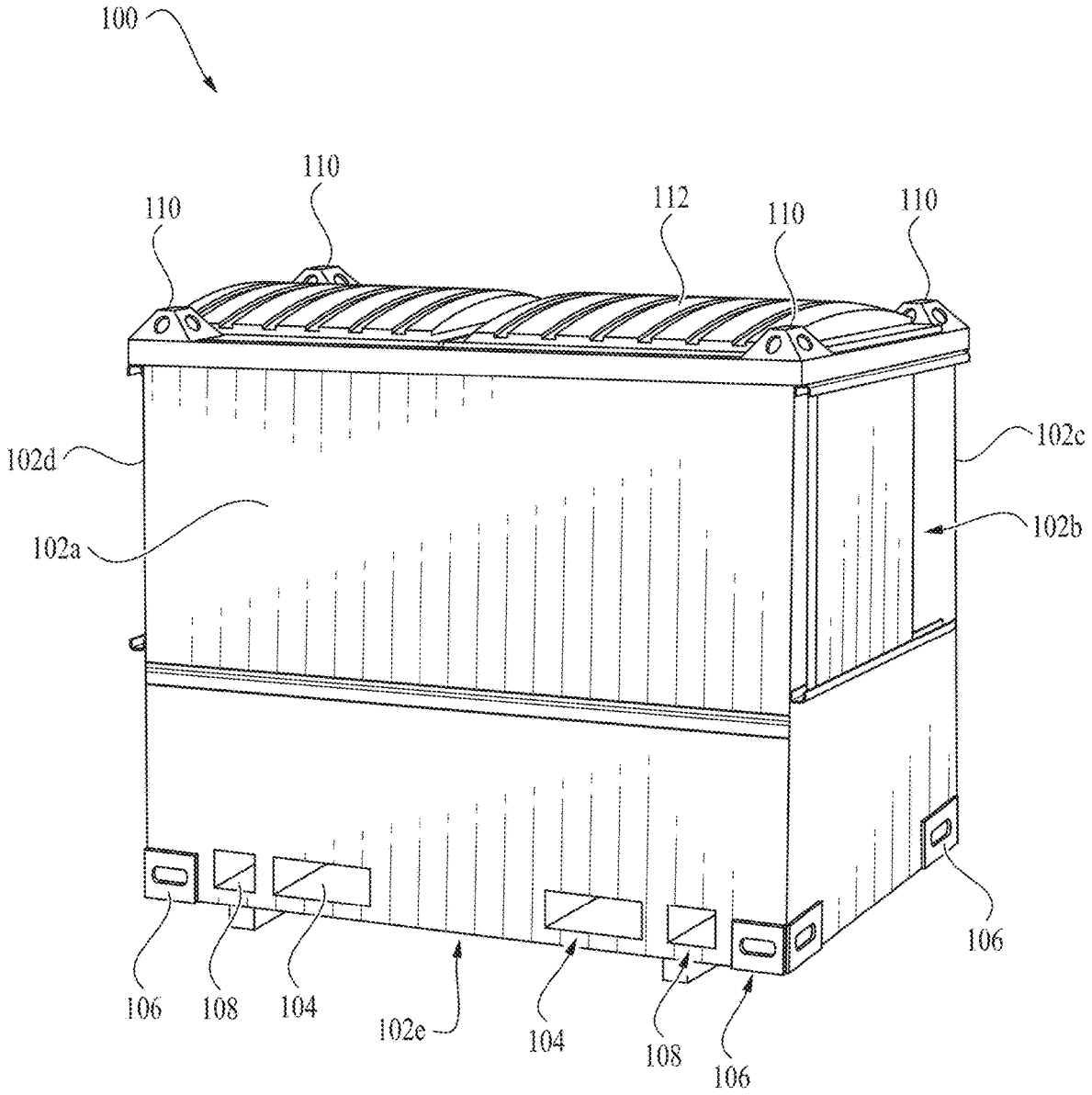
Figure 1G:
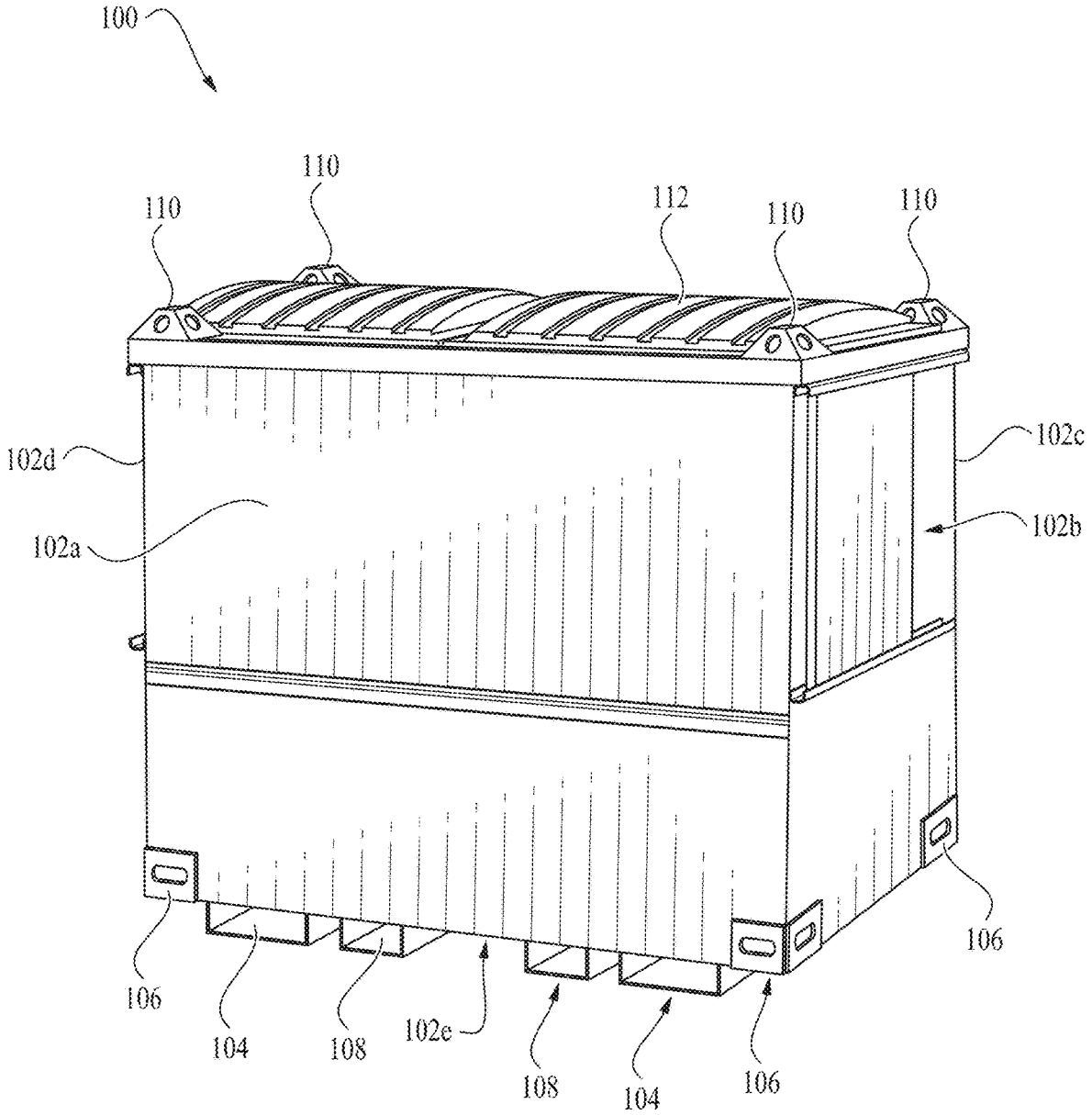

Referring now to FIGS. 1A and 1B, a bulk material container 100 according to one or more aspects of the present disclosure is illustrated. In one or more embodiments, the bulk material container 100 may include a body 102 containing four side walls 102*a*, 102*b*, 102*c*, and 102*d* and a bottom 102*e*. The body 102 may include a cavity 102*g* within the four side walls 102*a-d* and above the bottom 102*e* that leads to an opening 102*f* at a top of the body 102, which is spatially opposite of the bottom 102*e*. While the body 102 is depicted as including a plurality of side walls 102*a-d*, in one or more embodiments, the body 102 may include a single cylindrical or cone shaped side wall. Further, in one or more embodiments, the bulk material container may include one or more first engagement elements 104. The first engagement elements 104 may be formed so as to receive one or more engagement elements of a transportation device (not shown), which may be prongs or forks, such that the transportation device may lift and move the bulk material container 100 from one place to another. Furthermore, in one or more embodiments, the bulk material container 100 may include one or more second engagement elements 106. The second engagement elements 106 may be formed so that the bulk material container 100 may be coupled to a transportation vehicle or another bulk material container (not shown). Additionally, in one or more embodiments, the bulk material container 100 may include one or more third engagement elements 108. The third engagement elements 108 may be formed so as to receive one or more engagement elements of an unloading device (not shown), which may be prongs or forks, such that the unloading device may lift the bulk material container 100 to empty the wet proppant from the bulk material container 100 into a hopper or blending device to be mixed with a fluid to create a mixture for use in wellbore operations. While in one or more embodiments the unloading device may engage the third engagement elements 108, in other embodiments, the unloading device may engage the first engagement elements 104 or the second engagement elements 106 to lift the bulk material container to empty the wet proppant from the bulk material container 100.

In one or more embodiments, the side walls 102*a-d* may be substantially straight, and the sides of the cavity 102*g* within the body 102 of the bulk material container 100 may also be substantially straight. Thus, in one or more embodiments, a cross-sectional area may be substantially the same at a bottom of the cavity 102*g* as it is at the opening 102*f* of the body 102 of the bulk material container 100, which is the top of the cavity 102*g*. Therefore, when the bulk material container is turned upside down, gravity may be sufficient to fully empty a wet proppant from the bulk material container. In other embodiments, the cavity 102*g* may have a slight taper from the opening 102*f* of the body 102 at the top of the cavity 102*g* to the bottom of the cavity 102*g* such that the cross-sectional area at the bottom of the cavity 102*g* is slightly smaller than the cross-sectional area at the opening 102*f* (see for example FIG. 1J).

Further, in one or more embodiments, the first engagement elements 104 may be slots disposed through a bottom 102*e* of the body 102 within which one or more engagement elements of a transportation device and/or an unloading device may be disposed. In other embodiments, instead of forming slots through the bottom of the body, brackets may be coupled to a bottom of the bottom 102*e* of the body 102 such that slots are formed within which one or more engagement elements of the transportation device and/or the unloading device may be disposed. Furthermore, while two slots are shown, in one or more embodiments, a single slot may be formed or a single bracket may be coupled to the body such that the one or more engagement elements of the transportation device and/or the unloading device may be disposed within the single slot. Additionally, in one or more embodiments, the first engagement elements 104 may provide structural support to the bottom 102*e* of the body 102.

Additionally, in one or more embodiments, one of the second engagement elements 106 may be disposed in each of the four bottom corners of the body 102. The second engagement elements 106 may include slots through which a chain, rope, or strap may be disposed which allows for the bulk material container 100 to be coupled to the transportation vehicle or another bulk material container. In other embodiments, the second engagement elements 106 may be male or female portions of a locking mechanism, such as an ISO container lock or other twist lock, such that the bulk material container may be aligned with the corresponding female or male portions of the locking mechanism and locked to the transportation vehicle or another bulk material container. Further, in one or more embodiments, the second engagement elements 106 may be configured to be coupled to an unloading device such that the unloading device may empty the bulk material container 100.

Furthermore, in one or more embodiments, the third engagement elements 108 may be brackets coupled to two of the side walls (e.g., 102*b* and 102*d*) that are opposite from each other. The brackets may be coupled to the side walls such that slots are formed within which one or more engagement elements of the transportation device and/or one or more engagement elements of the unloading device may be disposed. In other embodiments, instead of coupling the brackets to the side walls (e.g., 102*b* and 102*d*) of the bulk material container 100, the brackets may be coupled to a bottom 102*e* of the body 102 of the bulk material container adjacent to the first engagement elements 104. In further embodiments, instead of coupling brackets to the side walls or bottom of the bulk material container, slots may be disposed through two of the side walls (e.g., 102*b* and 102*d*) that are opposite from each other or through the bottom 102*e* of the body 102 of the bulk material container 102 within which one or more engagement elements of the transportation device and/or the unloading device may be disposed. FIGS. 1C-1G illustrate some of the possible locations of the first engagement elements 104 and/or the third engagement elements 108 as described above.

Additionally, in one or more embodiments, the bulk material container 100 may include one or more locating elements 110. One of the locating elements 110 may be disposed in each of the four corners of the body 102 proximate to the top of side walls 102*b-d*. The locating elements 110 may include a protrusion that is configured to engage a slot formed in the second engagement elements 106 so as to align bulk material containers that are stacked on top of each other. Additionally, in one or more embodiments, the locating elements may be configured such that a crane may couple to the locating elements 110 and use the locating elements 110 to pick up the bulk material container 100 to transport it. In other embodiments, the locating elements may be female or male portions of a locking mechanism, such as an ISO container lock or other twist lock, such that the bulk material container 100 may be aligned with and locked to the corresponding male or female portions of the locking mechanism which are the second engagement elements of another bulk material container.

Further, in one or more embodiments, the bulk material container 100 may include a lid 112. The lid 112 may be coupled to one or more of the side walls 102*a-d* and may cover the opening 102*f*. Furthermore, the lid 112 may be removable such that the opening 102*f* may be fully exposed or may be hingedly coupled to one of the side walls 102*a-d* such that the lid 112 may be opened about the hinged connection to fully expose the opening 102*f* Additionally, in one or more embodiments, a locking mechanism may be coupled between one or more of the side walls 102*a-d* and the lid 112 such that the lid may be maintained covering the opening 102*f* when the bulk material container 100 is in transit or being stored.

Figure 1H:
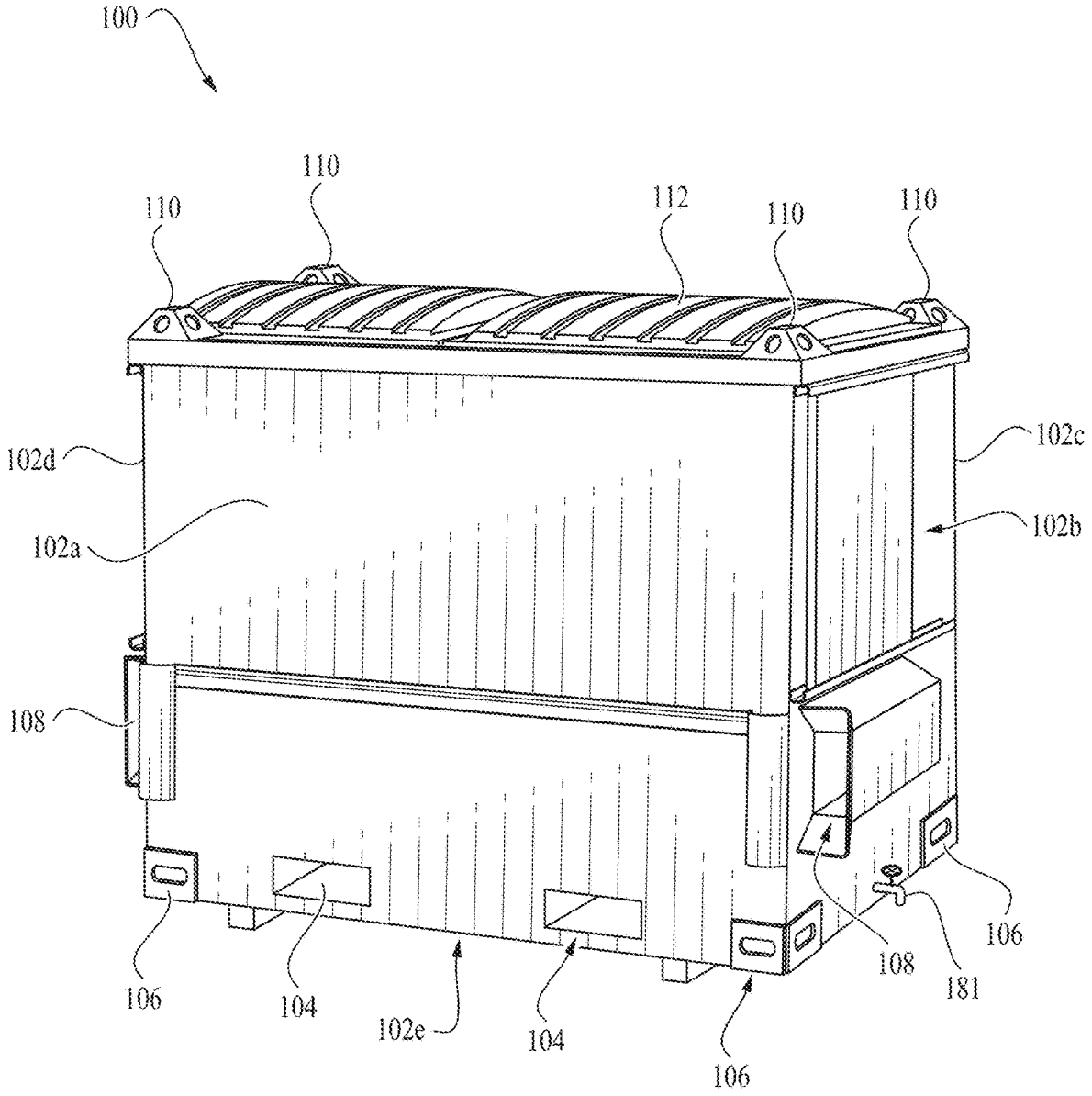
Figure 11:
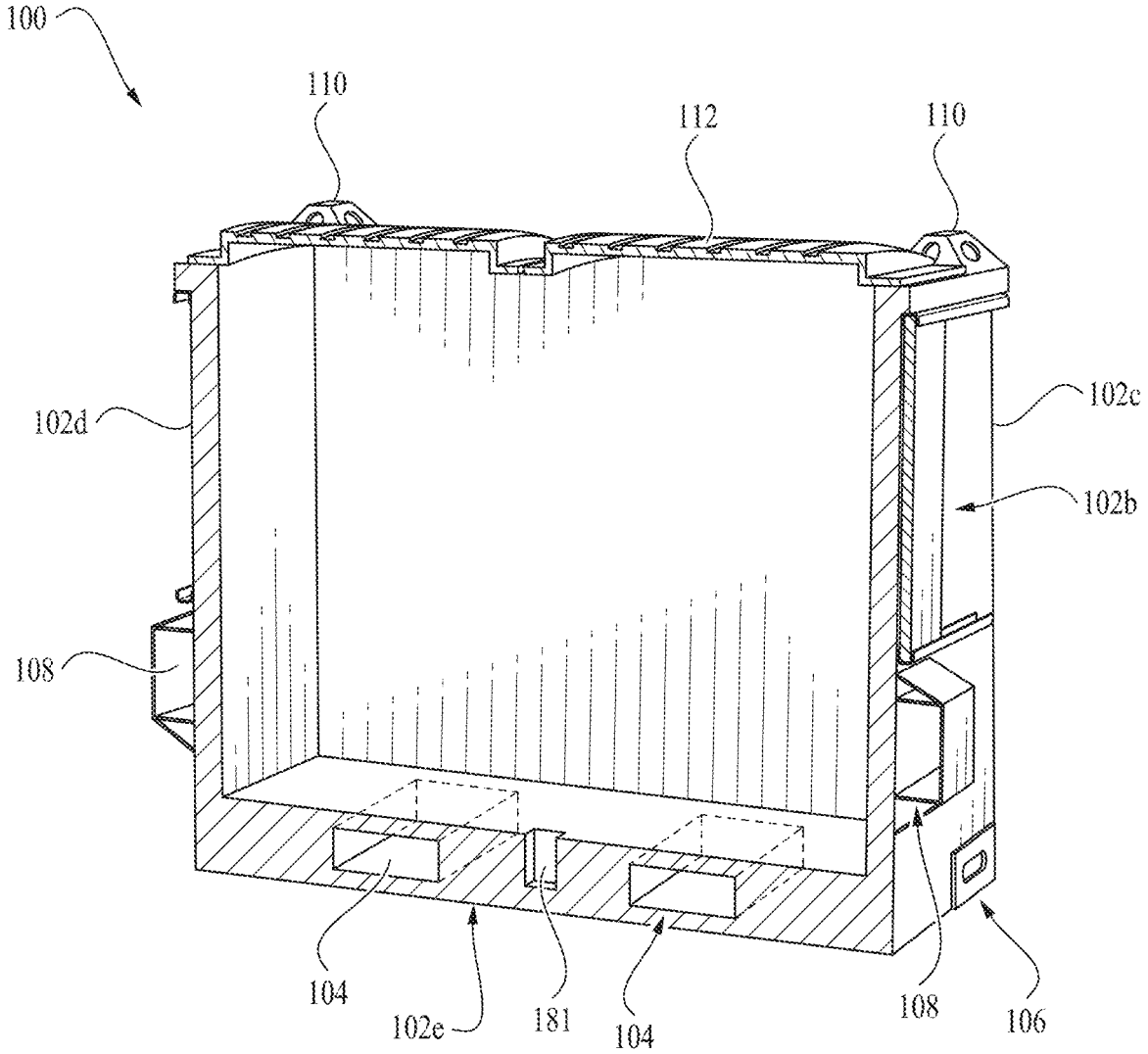
Figure 1J:
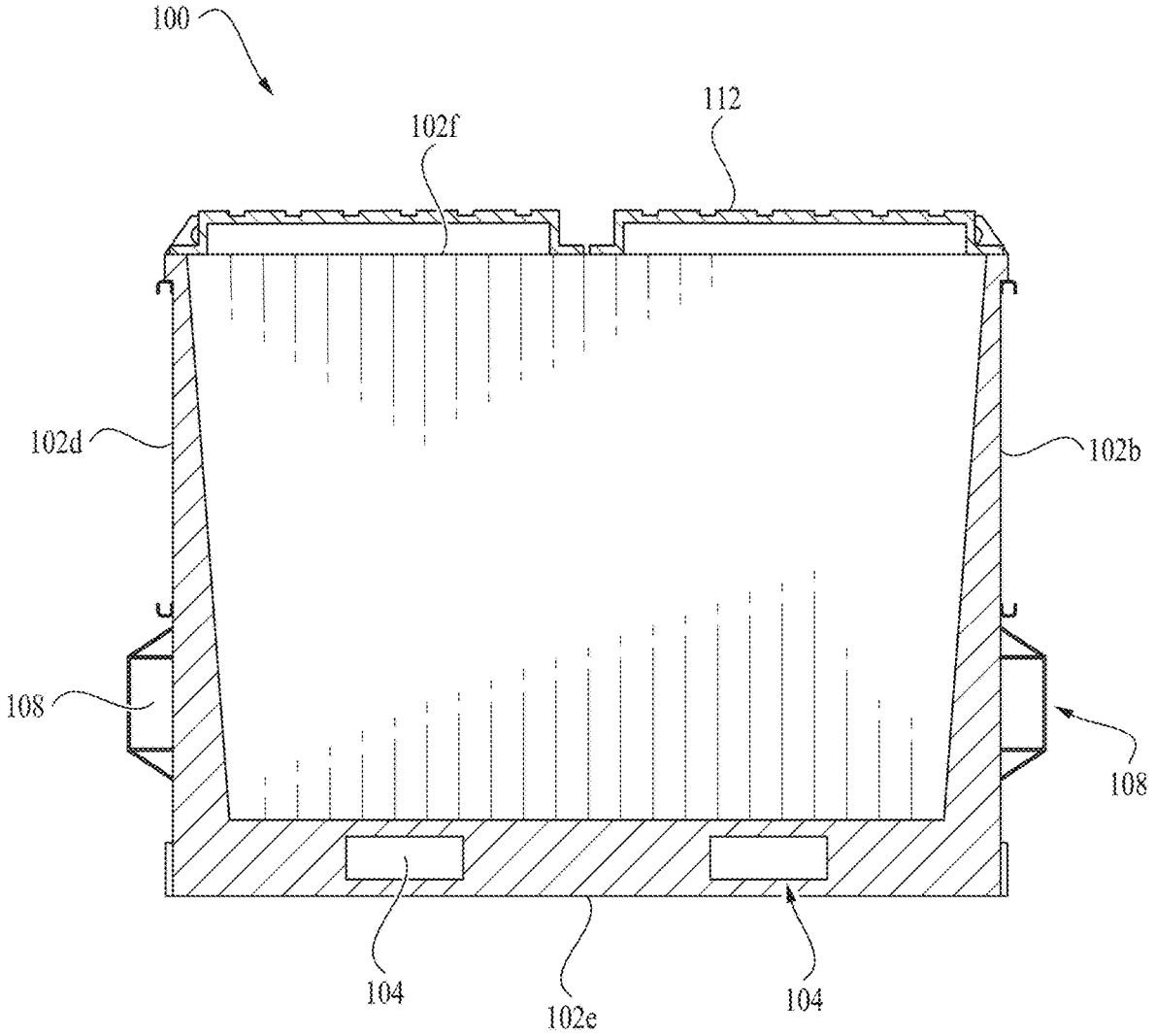

Furthermore, in one or more embodiments, the bulk material container 100 may include a valve 181. The valve 181 may be coupled to the bottom 102*e* or to one of the side walls 102*a-d* adjacent to the bottom 102*e* of the body 102. The valve 181 may be closed in the default position and may be opened to allow for the release of any built up fluid in the wet proppant that has settled to the bottom. FIGS. 1H-1I illustrate exemplary containers with a valve 181.

Figure 2:
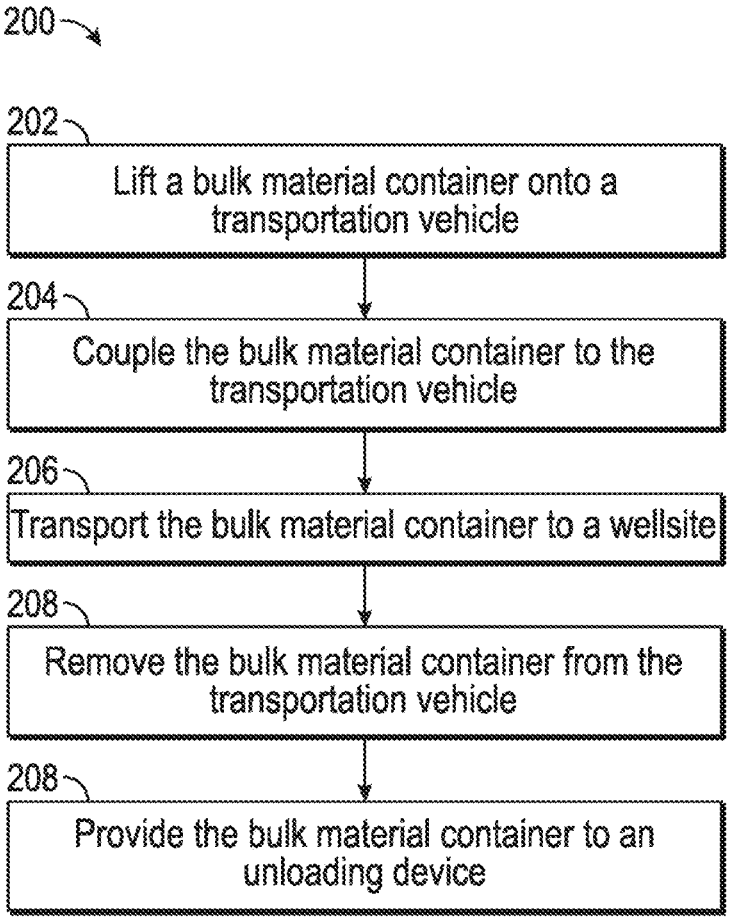
FIG. 2 is a flow diagram of an illustrative method for transporting and unloading bulk material according to one or more embodiments of the present disclosure.

Referring now to FIG. 2, a flow chart for a method 200 for transporting and unloading bulk material according to one or more aspects of the present disclosure is illustrated. In one or more embodiments, the method 200 may include lifting a bulk material container onto a transportation vehicle, coupling the bulk material container to the transportation vehicle, filling the bulk material container with a bulk material, transporting the bulk material container to a wellsite, removing the bulk material container from the transportation vehicle, and providing the bulk material container to an unloading device. At step 202, the bulk material container may be lifted onto a transportation vehicle. In one or more embodiments, lifting the bulk material container onto the transportation vehicle may include engaging first engagement elements or third engagement elements of the bulk material container using a transportation device such as a fork lift, a crane, an ISO container handler, or a telehandler, lifting the bulk material container, and disposing the bulk material container onto the transportation vehicle.

At step 204, the bulk material container may be coupled to the transportation vehicle, either directly or indirectly by way of another bulk material container disposed on the transportation vehicle. In one or more embodiments, the bulk material container may be coupled to the transportation vehicle or another bulk material container using second engagement elements of the bulk material container. The second engagement elements of the bulk material container may be coupled directly to the transportation vehicle or coupled to fourth engagement elements of another bulk material container. Further, coupling the bulk material container to the transportation vehicle or another bulk material container may include locking a locking mechanism of the second engagement elements to secure the bulk material container to the transportation vehicle or another bulk material container.

At step 205, the bulk material container may be filled with a bulk material. The bulk material container may be filled through the opening of the bulk material container. Further, in one or more embodiments, the bulk material used to fill the bulk material container may include a wet proppant. While in one or more embodiments, the bulk material container may be filled after the bulk material container is lifted onto a transportation vehicle and after the bulk material container is coupled to the transportation vehicle, in other embodiments, the bulk material container may be filled with the bulk material before the bulk material container is coupled to the transportation vehicle or before the bulk material container is lifted onto the transportation vehicle. Additionally, in one or more embodiments, once the bulk material container is filled, a lid of the bulk material container may be closed.

At step 206, the bulk material container may be transported to a wellsite by the transportation vehicle. Then, in one or more embodiments, at step 208, the bulk material container may be removed from the transportation vehicle at the wellsite. Removing the bulk material container from the transportation vehicle may include engaging first engagement elements, second engagement elements, or the third engagement elements of the bulk material container using a wellsite transportation device such as a fork lift, a crane, an ISO container handler, or a telehandler, and lifting the bulk material container. In one or more embodiments, removing the bulk material container from the transportation vehicle may further include disposing the bulk material container onto a ground of the wellsite where the bulk material container may then be stored at the wellsite until the bulk material is needed.

Further, at step 210, the bulk material container may be provided to an unloading device. In one or more embodiments, providing the bulk material container to the unloading device may include transporting the bulk material container to the unloading device, and disposing the bulk material container adjacent to the unloading device. Furthermore, in one or more embodiments, transporting the bulk material container to the unloading device may include engaging first engagement elements or third engagement elements of the bulk material container using the wellsite transportation device, lifting the bulk material container, and moving the bulk material container. Additionally, in one or more embodiments, disposing the bulk material container adjacent to the unloading device may include engaging engagement elements of the unloading device with the first engagement elements, the second engagement elements, or the third engagement elements of the bulk material container using the wellsite transportation device. Further, in one or more embodiments, the unloading device may be configured to at least partially invert the bulk material container to unload the bulk material from the bulk material container. While in one or more embodiments, the bulk material container may be provided to an unloading device to at least partially invert the bulk material container to unload the bulk material, in other embodiments, the transportation device may partially invert the bulk material container to unload the bulk material.

According to one or more aspects of the present disclosure, the bulk material container described herein is an efficient and cost-effective container for carrying and unloading wet proppant for use in wellbore operations. The bulk material container according to one or more aspects of the present disclosure limits the amount of bulk material left behind when the bulk material is wet and the bulk material container is emptied at a wellsite.

An embodiment of the present disclosure is a bulk material container. The bulk material container includes a body and one or more engagement elements. The bottom has a plurality of walls, a bottom, a cavity, and an opening. The plurality of side walls are coupled to the bottom, and the cavity is formed within the plurality of side walls and above the bottom. Further, the opening is formed by the plurality of side walls at a top of the cavity spatially opposite of the bottom. Furthermore, the cavity is configured to receive a bulk material, and the opening is configured to discharge the bulk material when the bulk material container is at least partially inverted. Additionally, the one or more first engagement elements are configured to receive one or more of one or more engagement elements of a transportation device or one or more engagement elements of a bulk material unloading device.

In one or more embodiments described in the preceding paragraph, the one or more first engagement elements are slots disposed through the bottom of the body. In one or more embodiments described in the preceding paragraph, the one or more first engagement elements are brackets coupled to the bottom. In one or more embodiments described in the preceding paragraph, the bulk material container includes one or more second engagement elements and one or more third engagement elements. The one or more second engagement elements are formed at one or more corners of the bottom, and the one or more third engagement elements are formed on either one or more of the plurality of side walls or the bottom. In one or more embodiments described in the preceding paragraph, the second engagement elements are slots configured to be coupled to one of a transportation vehicle or a second bulk material container. F In one or more embodiments described in the preceding paragraph, the second engagement elements are one of a male portion or a female portion of a locking mechanism configured to lock the bulk material container to one of a transportation vehicle or a second bulk material bulk material container. In one or more embodiments described in the preceding paragraph, the locking mechanism is one of an ISO container lock or a twist lock. In one or more embodiments described in the preceding paragraph, the second engagement elements are configured to be coupled to the bulk material unloading device and a transportation vehicle. Further, in one or more embodiments described in the preceding paragraph, the one or more third engagement elements are formed on the bottom or on one or more of the plurality of side walls. In one or more embodiments described in the preceding paragraph, the one or more third engagement elements are slots, where the one or more third engagement elements are configured to receive one or more of the one or more engagement elements of the bulk material unloading device or the one or more engagement elements of the transportation device. In one or more embodiments described in the preceding paragraph, the one or more third engagement elements are brackets coupled to one or more of the plurality of sides of the body, where the one or more third engagement elements are configured to receive one or more of the one or more engagement elements of the bulk material unloading device or the one or more engagement elements of the transportation device. Additionally, in one or more embodiments described in the preceding paragraph, the bulk material container further includes one or more locating elements, where the one or more locating elements are disposed approximate to a top of one or more of the plurality of side walls. In one or more embodiments described in the preceding paragraph, the one or more locating elements are configured to engage the one or more second engagement elements of a second bulk material container. In one or more embodiments described in the preceding paragraph, the one or more locating elements are one of a male or female portion of one of an ISO container lock or a twist lock. Moreover, in one or more embodiments described in the preceding paragraph, the bulk material container further includes a lid, where the lid is coupled to one of the plurality of side walls and is configured to cover the opening. In one or more embodiments described in the preceding paragraph, the bulk material container further includes a valve, where the valve is coupled to one of the bottom of the body or a bottom of one of the plurality of side walls of the body. In one or more embodiments described in the preceding paragraph, the plurality of side walls are substantially perpendicular to the bottom, and sides of the cavity are substantially perpendicular to the bottom. In one or more embodiments described in the preceding paragraph, sides of the cavity are tapered such that a cross sectional area at the top of the cavity is larger than the cross sectional area at a bottom of the cavity. Additionally, in one or more embodiments described in the preceding paragraph, the bulk material is a wet proppant. In one or more embodiments described in the preceding paragraph, the one or more first engagement elements provide structural support to the bottom of the body The present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A bulk material container, comprising:

a body comprising:

a plurality of side walls;

a bottom, wherein the plurality of side walls are coupled to the bottom;

a cavity, wherein the cavity is formed within the plurality of side walls and above the bottom, and wherein the cavity is configured to receive a bulk material; and an opening, wherein the opening is formed by the plurality of side walls at a top of the cavity spatially opposite of the bottom, and wherein the opening is configured to discharge the bulk material when the bulk material container is at least partially inverted; and a plurality of engagement elements, wherein the plurality of engagement elements comprise a first engagement element, a second engagement element, and a third engagement element, and wherein the first engagement element is configured for engagement by a wellsite transportation device having forks or prongs, the second engagement element is configured for engagement to a transportation vehicle or another similar bulk material container by a male or female portion of a locking mechanism, and the third engagement element is configured for engagement by an unloading device configured to at least partially invert the container and having prongs or forks which differ from those of the first engagement element.

2. The bulk material container of claim 1, wherein the first engagement element comprises slots disposed through the bottom of the body, and wherein the third engagement element comprises brackets on two of the plurality of side walls.

3. The bulk material container of claim 2, further comprising one or more locating elements, wherein the one or more locating elements are disposed approximate to one or more corners of a top of one or more of the plurality of side walls, wherein the second engagement element is formed at one or more corners of the bottom, and wherein the one or more locating elements are configured to engage the one or more second engagement elements of a second bulk material container.

4. The bulk material container of claim 1, wherein the first engagement element comprises brackets coupled to the bottom, and wherein the third engagement element comprises brackets on two of the plurality of side walls.

5. The bulk material container of claim 1, wherein the one or more second engagement elements are formed at one or more corners of the bottom elements are formed on either one or more of the plurality of side walls or the bottom.

6. The bulk material container of claim 5, further comprising one or more locating elements, wherein the one or more locating elements are disposed approximate to a top of one or more of the plurality of side walls.

7. The bulk material container of claim 6, wherein the one or more locating elements are configured to engage the one or more second engagement elements of a second bulk material container.

8. The bulk material container of claim 7, wherein the one or more locating elements are one of a male or female portion of one of the locking mechanism.

9. The bulk material container of claim 1, wherein the first engagement element comprises slots disposed through the bottom of the body, and wherein the third engagement element comprises slots disposed through the bottom of the body.

10. The bulk material container of claim 1, wherein the locking mechanism is one of an ISO container lock or a twist lock.

11. The bulk material container of claim 1, wherein the third engagement element is formed on the bottom and the first engagement element is formed on the bottom.

12. The bulk material container of claim 1, wherein the first engagement element comprises slots disposed through the bottom of the body, and wherein the third engagement element comprises slots disposed through two of the plurality of side walls, wherein the one or more third engagement elements are configured to receive one or.

13. The bulk material container of claim 1, wherein the first engagement element comprises brackets on the bottom, and wherein the third engagement element comprises slots disposed through two of the plurality of side walls of the body.

14. The bulk material container of claim 1, further comprising a lid, wherein the lid is coupled to one of the plurality of side walls and is configured to cover the opening.

15. The bulk material container of claim 1, further comprising a valve, wherein the valve is coupled to one of the bottom of the body or a bottom of one of the plurality of side walls of the body, wherein the bulk material comprises wet proppant, and wherein in an open position, the valve allows for release of any fluid in the wet proppant that has settled to the bottom.

16. The bulk material container of claim 1, wherein:

the plurality of side walls are substantially perpendicular to the bottom; and sides of the cavity are substantially perpendicular to the bottom.

17. The bulk material container of claim 1, wherein the sides of the cavity are tapered such that a cross sectional area at the top of the cavity is larger than the cross sectional area at a bottom of the cavity.

18. The bulk material container of claim 1, wherein the one or more first engagement elements provide structural support to the bottom of the body.

19. The bulk material container of claim 1, wherein the first engagement element comprises brackets disposed on the bottom, and the third engagement element comprises brackets disposed on the bottom.

20. The bulk material container of claim 1, further comprising one or more locating elements, wherein the one or more locating elements are disposed approximate to one or more corners of a top of one or more of the plurality of side walls, wherein the second engagement element is formed at one or more corners of the bottom, wherein the one or more locating elements are configured to engage the one or more second engagement elements of a second bulk material container, and wherein the first engagement element comprises brackets disposed on the bottom and the third engagement element comprises brackets disposed on the bottom or the first engagement element comprises slots disposed through the bottom of the body and the third engagement element comprises slots disposed through the bottom of the body.

* * * * *